US006091371A

United States Patent [19]

Buer et al.

[11] Patent Number: 6,091,371

[45] **Date of Patent: *Jul. 18, 2000**

[54] ELECTRONIC SCANNING REFLECTOR ANTENNA AND METHOD FOR USING SAME

[75] Inventors: Kenneth Vern Buer; David Warren Corman, both of Gilbert; Dean L. Cook, Mesa; Deborah Sue Dendy, Tempe, all of Ariz.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,810

[22] Filed: Oct. 3, 1997

[51] Int. Cl.[7] ..... H01Q 19/06

[52] U.S. Cl. ..... 343/754; 343/755; 343/909

[58] Field of Search ..... 343/753, 754, 343/755, 756, 781 R, 781 P, 909

[56] References Cited

U.S. PATENT DOCUMENTS

| | | | |
|---|---|---|---|
| 2,130,389 | 9/1938 | Gothe | 343/909 |
| 2,840,820 | 6/1958 | Southworth | 343/909 |
| 4,090,199 | 5/1978 | Archer | 343/100 SA |
| 4,095,230 | 6/1978 | Salmond et al. | 343/729 |
| 4,987,418 | 1/1991 | Kosowsky et al. | 342/6 |
| 5,262,796 | 11/1993 | Cachier | 343/909 |
| 5,312,790 | 5/1994 | Sengupta et al. | 501/137 |
| 5,349,363 | 9/1994 | Milroy | 343/772 |
| 5,361,076 | 11/1994 | Milroy | 343/772 |
| 5,412,394 | 5/1995 | Milroy | 343/785 |
| 5,469,165 | 11/1995 | Milroy | 342/13 |
| 5,483,248 | 1/1996 | Milroy | 343/785 |
| 5,583,524 | 12/1996 | Milroy | 343/772 |
| 5,706,017 | 1/1998 | Buttgenbach | 343/755 |
| 5,864,322 | 1/1999 | Pollon et al. | 343/909 |

FOREIGN PATENT DOCUMENTS

| | | | |
|---|---|---|---|
| 4332042 | 9/1993 | Germany | H01Q 17/00 |
| WO9310572 | 5/1993 | WIPO | H01Q 19/06 |
| WO9326059 | 12/1993 | WIPO | H01Q 15/00 |
| WO9413028 | 6/1994 | WIPO | H01P 1/18 |

*Primary Examiner*—Don Wong
*Assistant Examiner*—Tho Phan
*Attorney, Agent, or Firm*—Walter W. Nielsen; James E. Klekotka

[57] ABSTRACT

An antenna subsystem (120) which comprises an electronic scanning reflector antenna (400) is used for the formation of single and multiple beams. Reflecting surface (420) is covered with at least one dielectric layer (430) which is used to simultaneously and independently steer multiple beams. Electronic scanning reflector antenna (400) operates similar to a phased array antenna. ESRA (400) comprises a number of independent controllable reflecting surfaces (450) which are combined together in close proximity. Each one of the individual regions is covered by a dielectric layer, and the dielectric constant for each can be independently controlled. Electronic scanning reflector antennas (400, 600) are used in both space-based and terrestrial-based applications. Electronic scanning reflector antennas (400, 600) are used for both transmission and reception of electromagnetic signals.

27 Claims, 2 Drawing Sheets

ELECTRONIC SCANNING REFLECTOR ANTENNA AND METHOD FOR USING SAME

FIELD OF THE INVENTION

This invention relates generally to reflective antennas and, more particularly, to an electronic scanning reflector antenna and method for using same.

BACKGROUND OF THE INVENTION

Space-based and terrestrial-based communication systems must share a limited frequency spectrum. The need to constantly increase the capacity of space-based and terrestrial-based communications systems has resulted in the continuing evolution of antenna technology. Antennas provide multiple beams using spatial and/or polarization isolation techniques. Advances are still required to provide enhanced performance with respect to providing adaptive antenna beam patterns. Adaptive antenna patterns have been generated using a variety of active and passive phased arrays.

Communication systems have used phased array antennas to communicate with multiple users through multiple antenna beams. Typically, efficient bandwidth modulation techniques are combined with multiple access techniques, and frequency separation methods are employed to increase the number of users.

While the problems associated with the inefficient use of network resources plague a wide variety of communication networks, they have more serious consequences in networks which rely on RF communication links.

Increased efficiency can be obtained by improving the antenna being used for the RF communication link. Furthermore, there is no known low cost phased array topology practical at microwave and/or millimeter wave frequencies for forming simultaneous multiple beams from a single aperture.

Accordingly, a need exists for the formation of simultaneous independently steerable multiple beams in a low cost phased array antenna that is practical at microwave and/or millimeter wave frequencies.

In particular, there is a significant need for apparatus and methods for providing multiple beams from a single antenna which can be independently steered over a wide angle field of view.

BRIEF DESCRIPTION OF THE DRAWINGS

A more complete understanding of the present invention can be derived by referring to the detailed description and claims when considered in connection with the figures, wherein like reference numbers refer to similar items throughout the figures, and:

DETAILED DESCRIPTION OF A PREFERRED EMBODIMENT

Figure 1:
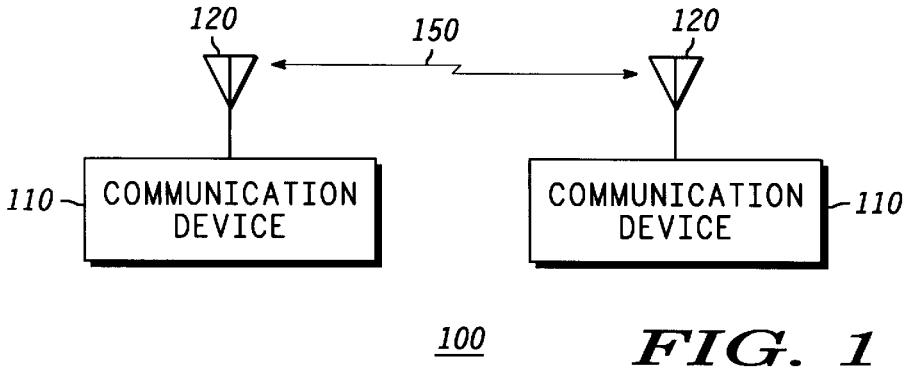
FIG. 1 shows a simplified block diagram of a communication system within which the apparatus and methods of the present invention can be practiced.

FIG. 1 shows a simplified block diagram of a communication system within which the apparatus and methods of the present invention can be practiced. FIG. 1 illustrates two communications devices 110. Two antenna subsystems 120 are coupled to the communication devices for establishing a communication link 150 between the two communication devices. Antenna subsystems 120 comprise at least one electronically controllable antenna in a typical spectrum sharing scenario. As illustrated, there is, typically, at least one line-of-sight path between the communication devices.

Communication devices 110 can be space-based and terrestrial-based communication devices. Space-based communication devices may reside in geostationary or non-geostationary orbits. In geostationary orbits, space-based communication devices remain relatively stationary to any given point on the surface of the earth. In non-geostationary orbits, space-based communication devices can move at high speed relative to any given point on the surface of the earth. In non-geostationary orbits, space-based communication devices can move at high speed relative to a space-based communication device in a geostationary orbit. Terrestrial-based communication devices are located proximate to the surface of the earth. The relative speeds between moving devices and relatively stationary devices mean that the communication devices have to dynamically alter the characteristics of their transmit and receive antenna beam patterns. In particular, antenna beam pointing directions are dynamically changing. Antenna subsystems 120 alter antenna beam patterns and vary the pointing directions over a wide angle field of view.

Antenna beam pattern requirements are different for communication devices operating in different environments. The antenna pattern required by a space-based communication device is different from the antenna pattern required by a terrestrial-based communication device. Likewise, a communication device located in a geostationary orbit has different antenna pattern requirements than a communication device located in a non-geostationary orbit.

When two or more communication channels occupy a common segment of the frequency spectrum, interference between two or more communication channels may occur. Interference paths are a problem in most communication system. Undesired line-of-sight paths can exist between communication devices 110. Communication devices 110 desirably employ electronic scanning reflector antennas (ESRA) to mitigate the interference problem. The below-discussed features of a preferred embodiment of the present invention can be practiced at any communication device 110 of communication system 100 or any communication device of other communications systems.

Communication devices 110 communicate with other communication devices 110 using radio frequency (RF) communication links 150. Communication devices 110 are preferably configured to communicate using time-division multiple access (TDMA), frequency-division multiple access (FDMA), code-division multiple access (CDMA) methods, or a combination thereof.

Figure 2:
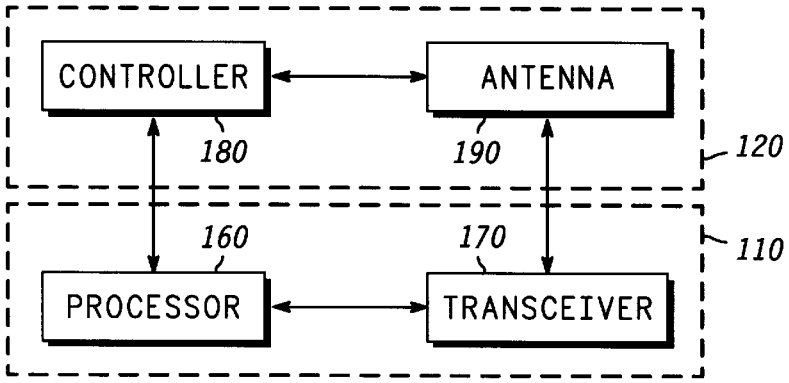
FIG. 2 shows a simplified block diagram of an electronic scanning reflector antenna for use in accordance with a first embodiment of the present invention.

FIG. 2 shows a simplified block diagram of communication device 110 and antenna subsystem 120 in accordance with a preferred embodiment of the present invention. Communication device 110 comprises at least one transceiver 170 and at least one processor 160 which is coupled to transceiver 170. Antenna subsystem 120 comprises at least one antenna 190 and at least one controller 180 which is coupled to antenna 190.

Antenna 190 (as illustrated) is coupled to transceiver 170. Controller 180 (as illustrated) is coupled to processor 160. Antenna 190 is desirably an electronic scanning reflector antenna. Controller 180 implements the necessary control functions which cause antenna 190 to form antenna beams with the desired characteristics.

RF signals are transferred between antenna 190 and transceiver 170. Although the signal path is illustrated as a single line, many interconnections are possible between antenna 190 and transceiver 170.

Digital data signals are transferred between controller 180 and antenna 190. In the receive mode, transceiver 170 converts the RF signals received from antenna 190 into digital data. In the transmit mode, transceiver 170 converts digital data obtained from processor 160 into RF signals. The RF signals are sent to antenna 190 by transceiver 170.

Control signals are transferred between controller 180 and processor 160. Digital data signals are also transferred between processor 160 and transceiver 170. RF signals received by transceiver 170 are converted to digital data which is sent to processor 160 to be further processed.

Antenna 190 includes elements (not shown in FIG. 2) preferably arranged in a two-dimensional array; however, other array configurations are suitable. In a preferred embodiment, RF signals are altered in the receive and transmit modes at the element level.

Figure 3:
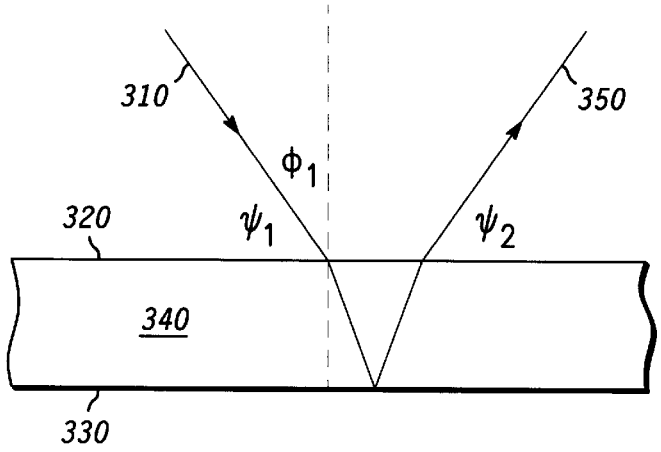
FIG. 3 illustrates the reflecting and refracting properties associated with a dielectric layer applied over a reflecting surface in accordance with a preferred embodiment of the present invention.

FIG. 3 illustrates the reflecting and refracting properties associated with a dielectric layer applied over a reflecting surface in accordance with a preferred embodiment of the present invention. Incident wave 310 is assumed to be a plane wave, and surfaces 320 and 330 are assumed to be large with respect to the wavelength of the plane wave. The two angles shown for the incident wave are known as the angle of incidence $\phi_1$ and the elevation angle $\psi_1$. The angle of incidence $\phi_1$ is the angle between the direction of propagation and a line normal to the surface. The elevation angle $\psi_1$ is the angle between the direction of propagation for the incident wave and the surface boundary. At the surface boundary the components of the E field and the H field are continuous. In other words, the phase of the reflected wave is synchronous with the phase of the incident wave.

Resultant wave 350 has an elevation angle $\psi_2$. Dielectric layer 340 causes $\psi_2$ to be different from $\psi_1$. Varying the dielectric constant of layer 340 causes elevation angle $\psi_2$ to change.

Figure 4:
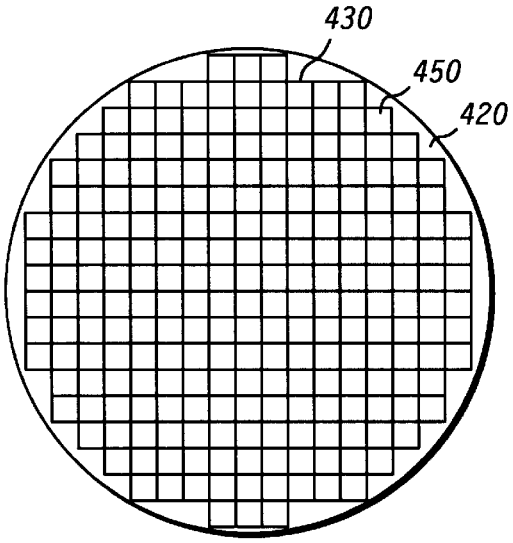
FIG. 4 illustrates a top view for an electronic scanning reflector antenna (ESRA) in accordance with a preferred embodiment of the present invention.
Figure 5:
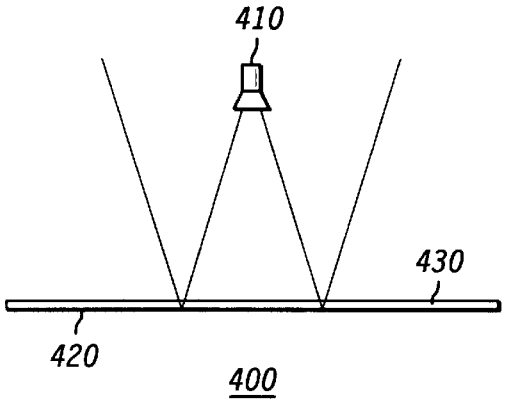
FIG. 5 illustrates a side view for an electronic scanning reflector antenna in accordance with a preferred embodiment of the present invention.

FIG. 4 illustrates a top view for an electronic scanning reflector antenna in accordance with a preferred embodiment of the present invention. FIG. 5 illustrates a side view for an electronic scanning reflector antenna in accordance with a preferred embodiment of the present invention. ESRA 400 comprises antenna feeder 410, RF reflecting surface 420, and an electrically-controllable dielectric layer 430 applied to RF reflecting surface 420. In a preferred embodiment, electrically-controllable dielectric layer 430 is a voltage variable dielectric material. The voltage variable dielectric material has a dielectric constant which changes in response to a direct current (DC) voltage that is applied to the material. Antenna feeder 410 and reflecting surface 420 may be coupled using various body structures (not shown).

Antenna feeder 410 may comprise a single or multiple sources. For example, in some embodiments, antenna feeder 410 is a single horn, and in other embodiments, antenna feeder 410 comprises several horn elements. In alternate embodiments, antenna feeder 410 is offset. In these cases, antenna feeder 410 and reflecting surface 420 are attached to a body structure (not shown), and antenna feeder 410 is located offset from the centerline of reflecting surface 420.

In a preferred embodiment, RF reflecting surface 420 comprises a plurality of individual elements 450. In this case, individual elements 450 are attached to a carrier surface to form an array. In addition, RF reflecting surface 420 is an electrical conductor, desirably a metal. RF reflecting surface 420 is used to provide one of the electrodes needed to establish an electric field across dielectric layer 430 and the other electrode (not shown) is located on another surface. In an alternate embodiment, RF reflecting surface 420 is a substantially continuous surface. In this case, RF reflecting surface 420 can be maintained at a single potential such as ground.

The ESRA has advantages over conventional fixed beam antennas because it can, among other things, provide greater viewing angles, adaptively adjust antenna beam patterns, provide antenna beams to individual users, provide antenna beams in response to demand for communication services and improve pattern nulling of unwanted RF signals. These features are implemented through appropriate software procedures performed in controller 180 (FIG. 2).

In an alternate embodiment, electrically-controllable dielectric layer 430 is a current variable dielectric material. The current variable dielectric material has a dielectric constant which changes in response to a DC current that is applied to the material.

The top view of ESRA 400 (FIG. 4) illustrates a preferred method for dividing dielectric layer 430 into smaller regions 450 which are independently controlled to produce the desired phase relationship to steer the antenna beams in any direction. This steering is accomplished by applying control voltages to the small regions of dielectric material. This allows antenna beams to be controlled faster than with a mechanical configuration. This ability allows hand-offs to take place faster. Since individual regions 450 of the antenna are controlled independently, ESRA 400 operates like a phased array antenna. ESRA 400, however, does not require costly discrete phase shift circuits at each element.

In alternate embodiments, multiple regions 450 are grouped together in rows and/or columns, and these rows and/or columns are controlled as groups. Superposition can be employed to provide each element a unique voltage and/or current required for the proper RF phase shift.

In alternate embodiments of the present invention, individual regions 450 can have different shapes than those illustrated in FIG. 4. For example, individual array elements can be any polygonal shape. Circles and/or ellipses can also be used. In other alternate embodiments, the number of regions 450 can be changed. For example, a simple antenna can comprise a single region 450, and this single region can have a variety of shapes.

In a preferred embodiment of the present invention, individual regions 450 do not touch each other. Small gaps are present to allow the placement of electrodes. The electrodes are used to establish an electric field in the dielectric layer 430. In alternate embodiments, gaps can be present between the individual regions or not. In addition, these gaps can vary in size and shape.

In a preferred embodiment, substantially all of RF reflecting surface 420 is covered with dielectric layer 430. In alternate embodiments of the present invention, RF reflecting surface 420 is partially covered by electrically-controllable dielectric layer 430. For example, some individual regions 450 can be covered with dielectric layer 430, and other individual regions 450 can be left uncovered.

In a preferred embodiment, dielectric layer 430 comprises a single type of electrically-controllable dielectric material. In alternate embodiments of the present invention, the entire RF reflecting surface is not covered by the same type of electrically-controllable dielectric material. For example, some individual regions 450 are covered with a first material, and some individual regions 450 are covered with a second material.

In a preferred embodiment, electrically-controllable dielectric 430 has a substantially uniform thickness across the face of the individual regions. In this case, individual regions 450 have a substantially uniform thickness for the electrically-controllable dielectric. In alternate embodiments, the thickness of the electrically-controllable dielectric varies across the individual regions. In some cases, the variation in thickness follows a linear relationship. In other cases, there is a non-linear relationship for the thickness of the electrically-controllable dielectric. In other alternate embodiments, the thickness for the electrically-controllable dielectric varies for different individual regions. In some cases, the electrically-controllable dielectric is thicker for the individual regions located near the center of the array pattern. In other cases, the electrically-controllable dielectric is thicker for the individual regions located near the edge of the array pattern.

In a preferred embodiment, electromagnetic radiation experiences a round trip phase shift that is twice the effective phase shift of the dielectric layer because the radiation passes through the layer twice.

In a preferred embodiment, electrically-controllable dielectric 430 is a ferroelectric material, preferably based on Barium Strontium Titanate (BST). In this case, a dielectric matching layer (not shown) is used between the BST and free-space. Since BST has a high relative dielectric constant, a dielectric matching layer is used to minimize reflections. The dielectric matching layer has a thickness which is approximately one quarter wavelength. In addition, the matching layer desirably has a dielectric constant which is approximately equal to the square root of BST. The dielectric constant for the matching layer is calculated using the geometric mean of the relative dielectric constants of the two media.

Figure 6:
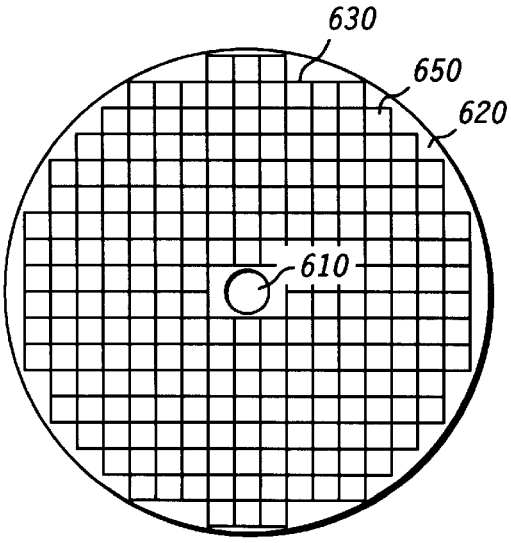
FIG. 6 illustrates a top view for an electronic scanning reflector antenna in accordance with a first alternate embodiment of the present invention.
Figure 7:
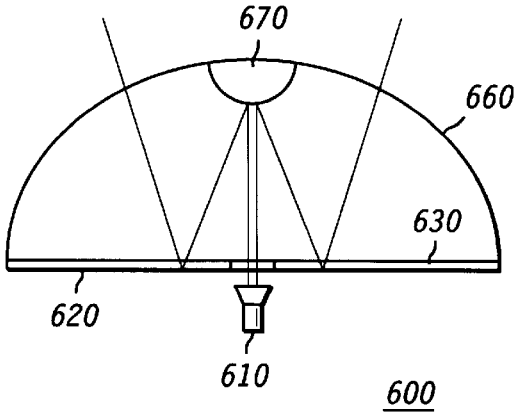
FIG. 7 illustrates a side view for an electronic scanning reflector antenna in accordance with a first alternate embodiment of the present invention.

FIG. 6 illustrates a top view for an electronic scanning reflector antenna in accordance with a first alternate embodiment of the present invention. FIG. 7 illustrates a side view for an electronic scanning reflector antenna in accordance with a first alternate embodiment of the present invention. ESRA 600 comprises antenna feeder 610, a first RF reflecting surface 620, a second RF reflecting surface 670, an electrically-controllable dielectric layer 630 applied to first RF reflecting surface 620, and body structure 660. For example, body structure 660 may be a radome. The voltage variable dielectric material has a dielectric constant which changes in response to a DC voltage that is applied to the material.

In another alternate embodiment, electrically-controllable dielectric layer 630 is a current variable dielectric material. The current variable dielectric material has a dielectric constant which changes in response to a DC current that is applied to the material.

The top view of ESRA 600 (FIG. 6) illustrates a preferred method for dividing dielectric layer 630 into smaller regions 650 which are independently controlled to produce the desired phase relationship to steer the antenna beams in any direction. This steering is accomplished by applying control voltages to the small regions of dielectric material, and this allows antenna beams to be changed faster than a mechanical configuration. Since individual regions 650 of ESRA 600 are controlled independently, ESRA 600 operates like a phased array antenna. ESRA 600, however, does not require costly discrete phase shift circuits at each element.

In other embodiments, multiple regions 650 are grouped together in rows and/or columns, and these rows and/or columns are controlled as groups. Superposition can be employed to provide each element a unique voltage and/or current required for the proper RF phase shift.

In other alternate embodiments of the present invention, the individual regions may have different shapes than those illustrated in FIG. 6. For example, individual array elements can be any polygonal shape. Circles and/or ellipses can also be used. In other alternate embodiments, the number of regions 650 can be changed. For example, a simple antenna may comprise a single region 650, and this single region may have a variety of shapes.

In alternate embodiments of the present invention, individual areas 650 do not touch each other. Gaps may be present between the individual areas. These gaps can vary in size and shape.

In a first alternate embodiment, most of RF reflecting surface 620 is covered with dielectric layer 630. In other alternate embodiments of the present invention, RF reflecting surface 620 is partially covered by electrically-controllable dielectric layer 630. For example, some individual regions 650 can be covered with a dielectric layer, and other individual regions 650 can be left uncovered.

In one embodiment, second RF reflecting surface 670 is metallic. In another embodiment, most of second RF reflecting surface 670 is covered with a dielectric layer. In a different embodiment of the present invention, second RF reflecting surface 670 is partially covered by an electrically-controllable dielectric layer.

In a first alternate embodiment, dielectric layer 630 comprises a single type of electrically-controllable dielectric material. In other alternate embodiments, the entire first RF reflecting surface 620 is not covered by the same type of electrically-controllable dielectric material. In these cases, some individual regions 650 are covered with a first material, and some individual regions 650 are covered with a second material In a first alternate embodiment, electrically-controllable dielectric 630 has a substantially uniform thickness across the face of individual regions 650. In a first alternate embodiment, all individual regions 650 have substantially the same uniform thickness for the electrically-controllable dielectric. In other alternate embodiments, the thickness of the electrically-controllable dielectric varies across the individual regions. In some cases, the variation in thickness follows a linear relationship. In other cases, there is a non-linear relationship for the thickness of the electrically-controllable dielectric. In other alternate embodiments, the thickness of the electrically-controllable dielectric varies for different individual regions. In some cases, the electrically-controllable dielectric is thicker for the individual regions located near the center of the array pattern. In other cases, the electrically-controllable dielectric is thicker for the individual regions located near the edge of the array pattern.

Using the apparatus and method of the present invention, an antenna beam pattern radiated from a communication device 110 (FIG. 1) has at least one main beam directed toward a desired direction. In addition, one or more nulls can be directed at interfering signals which are within the field of view of the antenna. To accomplish this, control matrices for the ESRA are continually adjusted to maintain the correct antenna pattern. The correct antenna pattern has main beams directed at the desired points and nulls in the directions of the interfering signals.

Any or all of the beams in the transmit and receive antenna patterns of a communication device 110 may be turned on or turned off. In addition, any or all of the nulls in the transmit and receive antenna patterns of a communication device 110 may be turned on or turned off in accordance with other nodes. The positioning of a null in the receive and transmit antenna patterns of a communication device 110 allows devices in two or more communication systems to share common channels.

Array antennas consisting of many controllable receiving/transmitting elements are very useful. The pattern of the array can be steered by applying linear phase weighting across the array. The array pattern can be shaped by amplitude and phase weighting the outputs of the individual elements. Increased capacity, reduced interference, and improved performance can be achieved through the use of adaptive antenna patterns formed using ESRAs.

One of the main characteristics of an ESRA is the ability to reject interfering signals. The amount of interference rejection is based on the control signals applied to a particular region in the dielectric layer. The control signals are determined and changed to establish nulls in the beam pattern, and these nulls are positioned in the direction of the interfering signals.

One of the main advantages of an ESRA system lies in the flexibility inherent in the system. Many different algorithms can be used to compute the antenna patterns and the associated control signals.

In an ESRA system, all the information received at the antenna interface is usable and is focused towards the antenna feed. The RF energy at each antenna element is phase-shifted by passing through the dielectric layer. In the antenna pattern forming process, the amount of phase shifting is controlled. Desirably, the dielectric layer does not alter the amplitude but does alter the phase so that when the summing takes place the desired antenna radiation pattern is formed. Adaptively forming an antenna radiation pattern using an ESRA is both a mathematical process and a physical process.

The method and apparatus of the present invention enable the communication devices in a communication system to adaptively change antenna radiation patterns. This is accomplished in the transmit and receive mode. Beam widths can be reduced and nulls can be varied to minimize the effect of interfering signals using an ESRA.

The present invention has been described above with reference to a preferred embodiment. However, those skilled in the art will recognize that changes and modifications can be made in this embodiment without departing from the scope of the present invention. For example, while a preferred embodiment has been described in terms of using a specific implementation for the electronic scanning reflector antenna, other systems can be envisioned which use different implementations. Accordingly, these and other changes and modifications which are obvious to those skilled in the art are intended to be included within the scope of the present invention.

What is claimed is:

1. An electronic scanning reflector antenna comprising:

a reflector for forming at least one beam, wherein said at least one beam is formed using a single reflection;

an electrically-controllable dielectric layer covering a first portion of said reflector, said electrically-controllable dielectric layer comprising a ferroelectric material; and a controller coupled to said electrically-controllable dielectric layer for controlling a dielectric constant of said electrically-controllable dielectric layer.

2. The electronic scanning reflector antenna as claimed in claim 1, wherein said reflector comprises a substantially continuous reflecting surface.

3. The electronic scanning reflector antenna as claimed in claim 1, wherein said electrically-controllable dielectric layer is a continuous layer and has a substantially uniform thickness.

4. The electronic scanning reflector antenna as claimed in claim 1, wherein said electrically-controllable dielectric layer is a continuous layer of a dielectric material having a non-uniform thickness.

5. The electronic scanning reflector antenna as claimed in claim 1, wherein said electrically-controllable dielectric layer is a discontinuous layer comprising a plurality of individual areas having substantially uniform thickness.

6. The electronic scanning reflector antenna as claimed in claim 1, wherein said electrically-controllable dielectric layer is a discontinuous layer comprising a plurality of individual areas having non-uniform thickness.

7. The electronic scanning reflector antenna as claimed in claim 1, wherein said electrically-controllable dielectric layer comprises multiple layers, said multiple layers having different dielectric constants.

8. The electronic scanning reflector antenna as claimed in claim 1, wherein said reflector has a discontinuous reflecting surface, said discontinuous reflecting surface comprising a plurality of individual segments, each of said plurality of individual segments having a reflecting surface.

9. The reflector as claimed in claim 8, wherein said plurality of individual segments have different geometric shapes.

10. The reflector as claimed in claim 8, wherein said plurality of individual segments have different sizes.

11. The reflector as claimed in claim 8, wherein said first portion comprises at least one of said plurality of individual segments having said electrically-controllable dielectric layer.

12. The reflector as claimed in claim 11, wherein said electrically-controllable dielectric layer is a continuous layer of a dielectric material having a uniform thickness.

13. The reflector as claimed in claim 11, wherein said electrically-controllable dielectric layer is a continuous layer of a dielectric material having a non-uniform thickness.

14. The reflector as claimed in claim 11, wherein said electrically-controllable dielectric layer comprises a plurality of dielectric materials having uniform thickness.

15. The reflector as claimed in claim 11, wherein said electrically-controllable dielectric layer comprises a plurality of dielectric materials having non-uniform thickness.

16. The electronic scanning reflector antenna as claimed in claim 1, wherein said controller controls a current through said electrically-controllable dielectric layer.

17. The electronic scanning reflector antenna as claimed in claim 1, wherein said controller controls a voltage across said electrically-controllable dielectric layer.

18. The electronic scanning reflector antenna as claimed in claim 1, wherein said controller uses control elements on a top and a bottom surface of said electrically-controllable dielectric layer.

19. The electronic scanning reflector antenna as claimed in claim 1, wherein said controller uses at least one control element on a side surface of said electrically-controllable dielectric layer.

20. The electronic scanning reflector antenna as claimed in claim 1, wherein said controller uses at least one multi-segment control element.

21. A method for using an electronic scanning reflector antenna for forming at least one beam, wherein said at least one beam is formed using a single reflection, said method comprising the steps of:

radiating said electronic scanning reflector antenna with at least one radio frequency (RF) signal;

causing, by an electrically-controllable dielectric layer, a first propagation direction change for said at least one RF signal;

causing, by a reflecting surface, a second propagation direction change for said at least one RF signal; and controlling said first propagation direction change and said second propagation direction change to form said at least one beam, said first propagation direction change being controlled by changing a dielectric constant of a ferroelectric material in said electrically-controllable dielectric layer.

22. A method for using an electronic scanning reflector antenna for forming at least one beam, wherein said at least one beam is formed using a single reflection, said method comprising the steps of:

radiating said electronic scanning reflector antenna with at least one radio frequency (RF) signal;

causing, by an electrically-controllable dielectric layer, a first propagation direction change for said at least one RF signal;

causing, by a reflecting surface, a second propagation direction change for said at least one RF signal;

causing, by said electrically-controllable dielectric layer, a third propagation direction change for said at least one RF signal; and controlling said first propagation direction change, said second propagation direction change, and said third propagation direction change to form said at least one beam, said first propagation direction change and said third propagation direction change being controlled by changing a dielectric constant of a ferroelectric material in said electrically-controllable dielectric layer.

23. A method for using an electronic scanning reflector antenna for forming at least one beam, wherein said at least one beam is formed using two reflections, said method comprising the steps of:

radiating a first reflecting surface with at least one radio frequency (RF) signal;

causing, by said first reflecting surface, a first propagation direction change for said at least one RF signal;

causing, by an electrically-controllable dielectric layer, a second propagation direction change for said at least one RF signal;

causing, by a second reflecting surface, a third propagation direction change for said at least one RF signal;

causing, by said electrically-controllable dielectric layer, a fourth propagation direction change for said at least one RF signal; and controlling said first propagation direction change, said second propagation direction change, said third propagation direction change, and said fourth propagation direction change to form said at least one beam, said second propagation direction change and said fourth propagation direction change being controlled by changing a dielectric constant of a ferroelectric material in said electrically-controllable dielectric layer.

24. A method for using an electronic scanning reflector antenna for forming at least one beam, wherein said at least one beam is formed using two reflections, said method comprising the steps of:

radiating a first reflecting surface with at least one radio frequency (RF) signal;

causing, by said first reflecting surface, a first propagation direction change for said at least one RF signal;

causing, by an electrically-controllable dielectric layer, a second propagation direction change for said at least one RF signal;

causing, by a second reflecting surface, a third propagation direction change for said at least one RF signal; and controlling said first propagation direction change, said second propagation direction change, and said third propagation direction change to form said at least one beam, said second propagation direction change being controlled by changing a dielectric constant of a ferroelectric material in said electrically-controllable dielectric layer.

25. An electronic scanning reflector antenna system comprising:

at least one electrically-controllable reflector antenna, wherein said at least one electrically-controllable reflector antenna further comprises a reflector for forming at least one beam, said at least one beam being formed using a single reflection, an electrically-controllable dielectric layer covering a first portion of said reflector, and a controller coupled to said electrically-controllable dielectric layer, said controller steering said at least one beam by controlling a dielectric constant of said electrically-controllable dielectric layer, said electrically-controllable dielectric layer comprising a ferroelectric material; and an antenna feeder coupled to said at least one electrically-controllable reflector antenna, said antenna feeder comprising at least one radiating element.

26. The electronic scanning reflector antenna system as claimed in claim 25, wherein said electronic scanning reflector antenna system further comprises at least one body structure coupled to said at least one electrically-controllable reflector antenna.

27. The electronic scanning reflector antenna system as claimed in claim 25, wherein said electronic scanning reflector antenna system further comprises at least one other reflecting surface for changing a propagation direction of said at least one beam.

* * * * *